United States Patent [19]

Hayashi et al.

[11] Patent Number: 4,855,970

[45] Date of Patent: Aug. 8, 1989

[54] TIME INTERVAL MEASUREMENT APPARATUS

[75] Inventors: Yoshihiko Hayashi, Yokohama; Ritsuro Orihashi, Tokyo, both of Japan

[73] Assignee: Hitachi, Ltd., Tokyo, Japan

[21] Appl. No.: 136,937

[22] Filed: Dec. 23, 1987

[30] Foreign Application Priority Data

Dec. 26, 1986 [JP] Japan ..... 61-308419

[51] Int. Cl.[4] ..... G04F 87/00

[52] U.S. Cl. ..... 368/120; 307/106

[58] Field of Search ..... 368/113–122; 307/107, 108; 324/51, 52

[56] References Cited

U.S. PATENT DOCUMENTS

| | | | |
|---|---|---|---|
| 4,165,459 | 8/1979 | Curtice | 368/119 |
| 4,362,394 | 12/1982 | Menlove | 368/118 |
| 4,613,951 | 9/1986 | Chu | 368/120 |
| 4,719,608 | 1/1988 | Genat et al. | 368/120 |
| 4,720,822 | 1/1988 | Hansen | 368/115 |

OTHER PUBLICATIONS

Hewlett Packard 5370A Universal Time Interval Counter Operating & Service Manual, (1979), pp. 8-2-9-8-31.

*Primary Examiner*—Bernard Roskoski

*Attorney, Agent, or Firm*—Antonelli, Terry & Wands

[57] ABSTRACT

An object of the present invention is to provide a time interval measurement circuit having especially high time measurement precision and resolution in time interval measurement between two signals and requiring short measurement time. In order to achieve the above described object, a time interval measurement circuit according to the present invention comprises two parallel transmission lines, differential output drivers connected to both ends of said transmission lines, a plurality of potential difference sensing means so disposed between said transmission lines at predetermined intervals as to generate an output signal upon an excess of potential difference between said two transmission lines over a predetermined level, and means for detecting, on the basis of output signals supplied from said potential difference sensing means, which potential difference sensing means has generated an output signal. Owing to this configuration, the time resolution depends upon the disposition intervals of said potential difference sensing means, resulting in high resolution. The measurement time can also be shortened because it depends upon the time taken for the signal to propagate between both ends of the transmission line.

27 Claims, 4 Drawing Sheets

TIME INTERVAL MEASUREMENT APPARATUS

BACKGROUND OF THE INVENTION

The present invention relates to measurement of a time interval between two signals, and in particular to a time interval measurement circuit requiring short measurement time suitable for requirements of high time measurement precision and high resolution.

In a conventional high-precision time interval measurement circuit, an interpolating technique is used. The interpolating technique is described in HEWLETT PACKARD 5370A UNIVERSAL TIME INTERVAL COUNTER OPERATING AND SERVICE MANUAL (1979) pp. 8-29 to 8-31. When this method is used, the time intervals between the base clock (200 MHz) within a time interval counter and the start signal as well as the stop signal are measured correctly. The time interval between the two signals is desired to be measured. By referring to FIG. 4, the method for measuring the time interval between an input signal fi 200 (start signal or stop signal) inputted to the time interval counter and the base clock will now be described. A variable clock fv 201 (having a period of 5.0195763 ns) is so generated as to begin to oscillate in synchronism with the falling edge of the input signal fi 200 and have a period nearly equal to that of the base clock fs 202 (having a period of 5 ns). Assuming that the number of pulses counted until the rising edge of the variable clock fv 201 thus generated coincides in time with the rising edge of the base clock fs 202 as N1, time interval Td between the input signal fi and the base clock fs can be represented as $$Td = \left(\frac{1}{fv} - \frac{1}{fs}\right) \cdot N1 \tag{1}$$

where fv is the frequency of the variable clock, and fs is the frequency of the base clock. For improving the measurement precision, therefore, it is necessary to make $$\left(\frac{1}{fv} - \frac{1}{fs}\right)$$

small. That is to say, the time interval between the period of the base clock fs and the period of the variable clock fv must be chosen so as to be small. In case of the prior art, this time interval is chosen to be approximately 20 ps. At worst, therefore, the number $N_1$ of pulses and the time T required for the measurement are represented as $$N_1 = \frac{5\text{ ns}}{20\text{ ps}} = 250 \text{ and } T = \frac{N_1}{fs} = \frac{250}{200 \times 10^6} = 1.25\ \mu\text{s}.$$

In case of the above described prior art, consideration is not given to the measurement time. The prior art thus has a problem that raising the time resolution of measurement results in proportionately increased measurement time.

SUMMARY OF THE INVENTION

An object of the present invention is to provide a time interval measurement circuit in which the measurement time is not increased even when the time resolution is raised.

The above described object is attained by a time interval measurement circuit comprising two parallel transmission lines, differential output drivers respectively connected to ends of the transmission lines, a plurality of potential difference sensing means so disposed between the transmission lines at predetermined intervals as to generate an output signal upon an excess of the potential difference between two transmission lines over a predetermined level, and output signal detection means for detecting the output signal generated by the potential difference sensing means.

Two signals whose time interval should be measured are inputted to respective inputs of two differential output drivers each providing complementary outputs at respective outputs thereof which are connected to a corresponding end of two parallel transmission lines having potential difference sensing means disposed thereon at fixed intervals. The two signals inputted from both ends overlap each other on the transmission lines. Depending upon the time interval of the two signals inputted from both ends of the transmission lines, the position at which the potential difference sensing means generates its output is changed. By detecting the above described position, therefore, the time interval between the two signals is detected.

DESCRIPTION OF THE PREFERRED EMBODIMENTS

Figure 1:
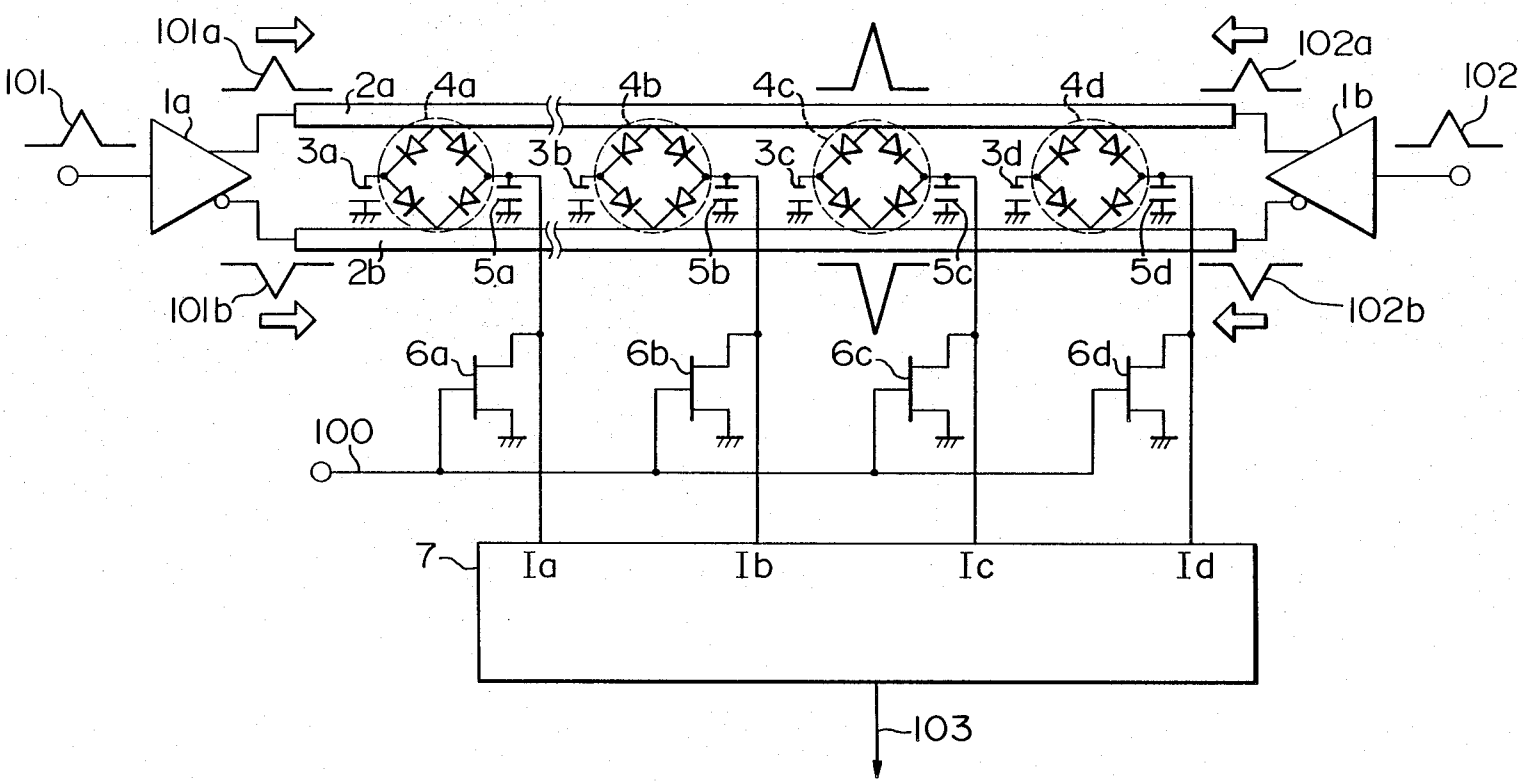
FIG. 1 shows a time interval measurement circuit supplied with pulse waveforms as input signals which is a first embodiment of the present invention.

Embodiments of the present invention will now be described by referring to the drawings.

Figure 2:
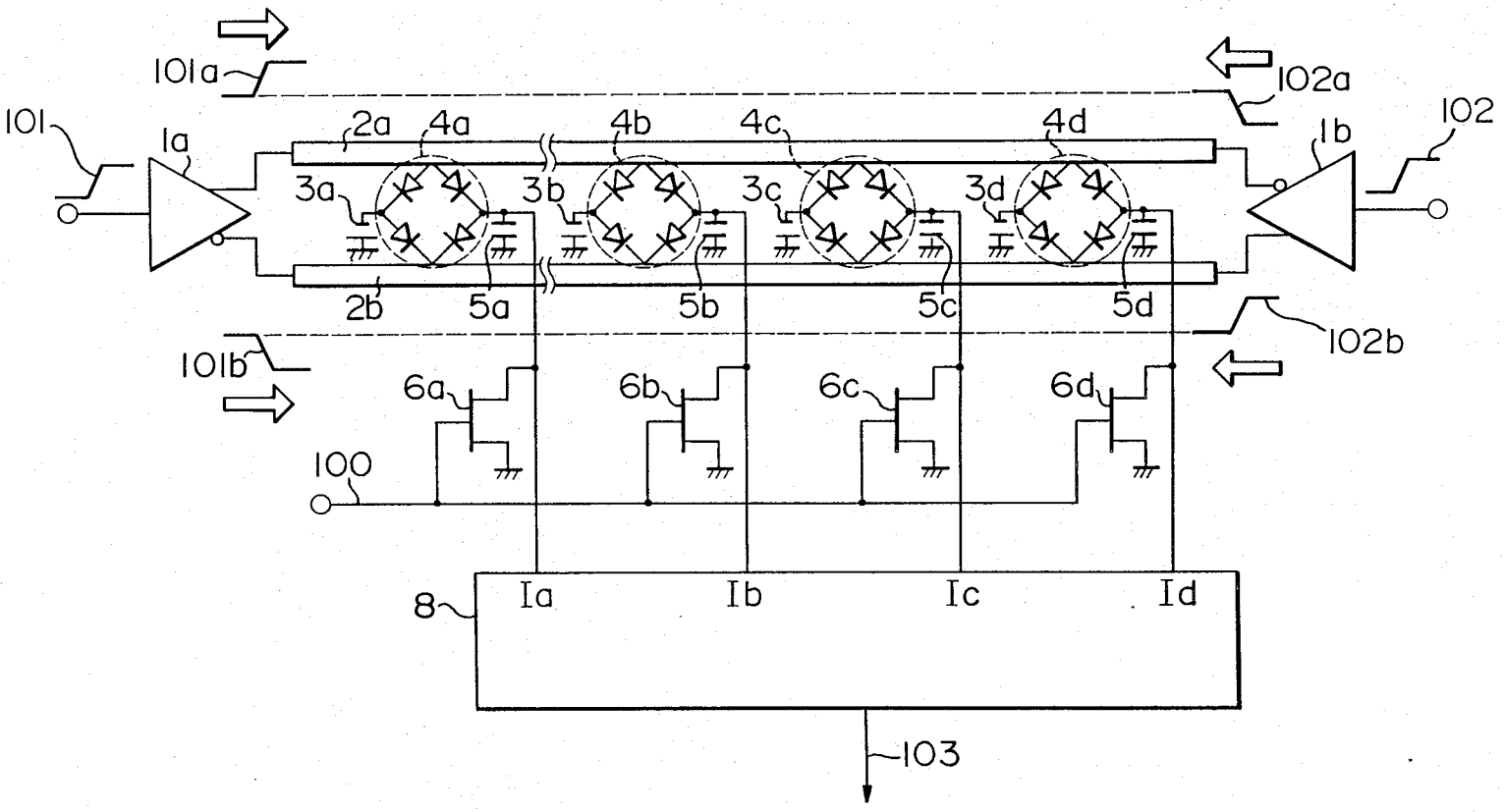
FIG. 2 shows a time interval measurement circuit supplied with step waveforms as input signals which is a second embodiment of the present invention.
Figure 3:
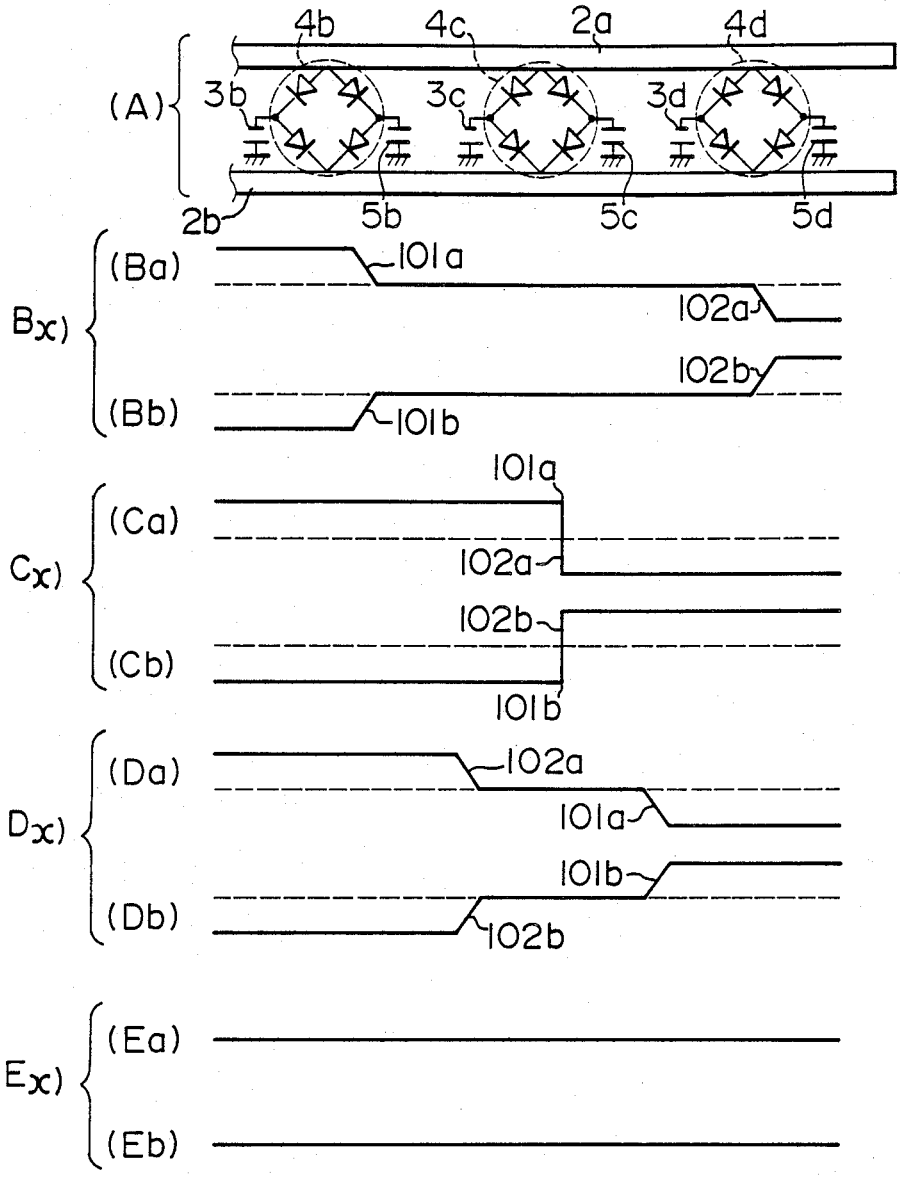
FIG. 3 shows operation waveforms for explaining the second embodiment.
Figure 4:
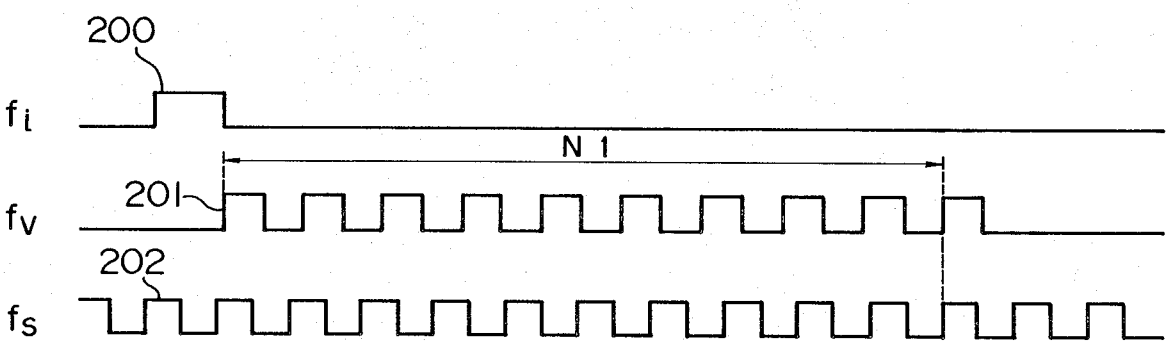
FIG. 4 PRIOR ART
FIG. 4 shows operation waveforms for explaining the interpolating technique which is the prior art.

FIG. 1 shows a first embodiment of the present invention. FIG. 2 shows a second embodiment of the present invention which is different in operation from the embodiment of FIG. 1. FIG. 3 shows the operation waveform of FIG. 2.

First of all, an embodiment of the present invention will now be described by referring to FIG. 1. As shown in FIG. 1, a time interval measurement circuit according to the present invention includes drivers 1a and 1b for driving transmission lines, two parallel transmission lines **2*a* and 2*b*, diode bridges 4*a* to 4*d* disposed on the transmission lines 2*a* and 2*b* at fixed intervals, voltage sources 3*a* to 3*d* connected to ends of respective diode bridges, capacitors 5*a* to 5*d* connected to other ends of respective diode bridges, FET switches 6*a* to 6*d* for discharging the charge stored in the capacitors, and a decoder 7** for detecting the diode switch which has turned on.

Prior to measuring the time interval of input signals 101 and 102, FETs **6*a* to 6*d* are turned on by a reset signal 100 to discharge the charge stored in the capacitors 5*a* to 5*d*. As a result, the voltage across each of the capacitors 5*a* to 5*d*** is made zero.

The input signal 101 is inputted to the driver 1*a*. A positive pulse 101*a* having a shape similar to that of the input signal 101 and a negative pulse 101*b* having an inverted polarity with respect to the input signal are outputted from the driver 1*a*. The output impedance of each of the drivers 1*a* and 1*b* is equal to the characteristic impedance Zo of the transmission line. At this time, the voltage amplitude of the positive pulse 101*a* and the negative pulse 101*b* is so set that the diode switches 4*a* to 4*d* will not turn on but they will turn on for doubled voltage amplitude.

On the other hand, the input signal 102 is also inputted to the driver 1*b* in the same way. A positive pulse 102*a* having a shape similar to that of the input signal 102 and a negative pulse 102*b* are outputted from the driver 1*b* to the transmission lines 2*a* and 2*b*.

The positive pulses 101*a* and 102*a* overlap each other on the transmission line 2*a*. The negative pulses 101*b* and 102*b* overlap each other on the transmission line 2*b*. In FIG. 1, the positive pulses 101*a* and 102*a* overlap each other and the negative pulses 101*b* and 102*b* overlap each other at the position of the diode switch 4*c*.

If the pulses completely overlap each other, the amplitude is doubled and hence the diode switch 4c turns on. When the diode switch turns on, a current flows from the voltage source 3*c* to the capacitor 5*c* via the diode switch 4*c* to store the charge in the capacitor 5*c*. Accordingly, potential difference is generated across the capacitor 5*c*. Therefore, only the input terminal $I_c$ of the decoder 7 changes to the "H" level. By detecting which diode bridge has turned on, time interval data 103 corresponding to the time interval between the input signal 101 and the input signal 102 is obtained.

Operation of the second embodiment will now be described by referring to FIGS. 2 and 3. Since the time interval measurement circuit according to the present invention as shown in FIG. 2 is nearly the same as the time interval measurement circuit shown in FIG. 1, different points will now be described. The non-inverted output of the driver 1*b* is connected to the transmission line 2*b*, and the inverted output of the driver 1*b* is connected to the transmission line 2*a*. (This connection is opposite to the connection shown in FIG. 1.) A decoder 8 detects how many inputs in succession from the input $I_a$ among inputs $I_a$ to $I_d$ have "H" levels and outputs the time interval data 103 on the basis of the number of inputs having "H" levels. Further, this embodiment differs from the operation of the circuit shown in FIG. 1 in that the time interval between the input signals is measured by using the rising edge of the input signal having a step waveform.

In the same way as FIG. 1, the charge of the capacitors 5*a* to 5*d* is discharged by the reset signal 100 prior to the measurement of the time interval of the input signals 101 and 102.

A rising edge 101 of the input signal having a step waveform is supplied to the driver 1*a*. A rising edge 101*a* having a shape similar to that of the rising edge 101 of the input signal and a falling edge 101*b* inverted in polarity with respect to the rising edge 101 are outputted from the driver 1*a*. The output impedance of the driver 1*a* is equal to the characteristic impedance Zo of the transmission line. At this time, the amplitude of the rising edge 101*a* and the amplitude of the falling edge 101*b* are so set that they will be equal to each other and a diode bridge will turn on at these amplitudes wherein the edge speed of the rising edge is equal to the edge speed of the falling edge.

On the other hand, a rising edge 102 of the input signal having a step waveform is inputted to the driver 1*b* in the same way. A falling edge 102*a* and a rising edge 102*b* are outputted from the driver 1*b* to the transmission lines 2*a* and 2*b*. The amplitude and the edge speed of each of falling edge 102*a* and the rising edge 102*b* is equal to those of the rising edge 101*a*.

The operation will now be described in detail by referring to FIG. 3. FIG. 3 A illustrates portions of the transmission lines 2*a* and 2*b*, the diode bridges 4*b* to 4*d*, the voltage sources 3*b* to 3*d*, and the capacitors 5*b* to 5*d*. FIGS. 3(Bx) to 3(Ex) shows operation waveforms. Operation waveforms represented by x=a are operation waveforms appearing on the transmission line 2*a*, while operation waveforms represented by x=b are operation waveforms appearing on the transmission line 2*b*.

Upon the rising edge 101*a* and the falling edge 101*b* shown in FIGS. 3(Ba) and (Bb), the diode bridge 4*b* located on the transmission line turns on, and hence the capacitor 5*b* is charged by the voltage source 3*b*. On the other hand, the falling edge 102*a* and the rising edge 102*b* also proceed along the transmission lines 2*a* and 2*b* toward the left side of FIG. 3. Since a reverse-biased potential is not formed with respect to any diode bridge, however, diodes do not turn on and remain off, holding capacitors discharged. When some time has elapsed, the rising edge 101*a* and the falling edge 102*a* overlap each other and the falling edge 101*b* and the rising edge 102*b* overlap each other as represented by operation waveforms of FIGS. 3(*a*) and (*b*). The diode bridges 4*b* and 4*c* located to the left side of FIGS. 3(*a*) and (*b*) with respect to the overlapping point turn on wherein charge is stored in the capacitors 5*b* and 5*c*. Since the diode bridge 4*d* located on the right side does not turn on, however, the charge stored in the capacitor 5*d* is zero. Operation waveforms obtained when some time has further elapsed are shown in FIGS. 3(Da) and 3(Db). The rising edge 101*a* and the falling edge 101*b* further proceed to the right side, while the falling edge 102*a* and the rising edge 102*b* proceed leftward. Since both the potential of the transmission line between the falling edge 102*a* and the rising edge 101*a* and the potential of the transmission line between the rising edge 102*b* and the falling edge 101*b* become zero, the diode bridge 4*c* located between these edges turns off. However, the charge previously stored in the capacitor 5*c* during the time when the diode bridge was turned on remains stored therein, i.e., it is memorized. Eventually, the potential becomes zero everywhere on the transmission lines 2*a* and 2*b* as shown in FIGS. 3(EA) and 3(Eb). As heretofore described, the diode bridges disposed on the transmission lines turn on in accordance with the time interval between the rising edges 101 and 102 of the input signal. As far as which ones of the capacitors 5*a* to 5*d* have already been charged by the turning-on of the diode bridges 4 is detected by the decoder 8. It is thus possible to obtain time interval data corresponding to the time interval between the rising edges 101 and 102 of the input signal. speed of the input signal is slow, the edge speed at overlapped edge portion of the transmission lines In the above description of the present embodiment, the number of diode bridges was 4. However, the present invention is not limited by the number of the diode bridges and the distance between diode bridges.

When the present invention is used, as the time resolution is defined by the electrical length of the transmission lines connected between diode switches, any voluntary selection becomes possible. Since the measurement time is defined by the time taken for the input signal to propagate from one end of the transmission line to the other end thereof, the time difference between two signals can be measured in high speed and high time resolution.

We claim:

1. A time interval measurement circuit comprising:

two parallel transmission lines;

first and second differential output drives, each having an input terminal for receiving an input signal and a pair of output terminals for providing output signals and wherein the pair of output terminals of said first and second differential output drivers are respectively coupled to first and second ends of said transmission lines;

a plurality of potential difference sensing means each being respectively coupled between said transmission lines and distributed thereat at predetermined intervals so as to generate an output signal indicative of a potential difference between said two transmission lines which is above a predetermined level in response to transmission line signals from the outputs of said first and second output drivers; and output signal detection means coupled to said plurality of potential difference sensing means for detecting output signals generated by said potential difference sensing means whereby the time interval between respective input signals applied at the input terminals of said differential output drivers is measured.

2. A time interval measurement circuit according to claim 1, wherein said detection means comprises a decoder.

3. A time interval measurement circuit according to claim 1, wherein an input signal applied to one of said transmission lines comprises a step waveform signal having a rising edge, and an input signal applied to the other of said transmission lines comprises a step waveform signal having a falling edge.

4. A time interval measurement circuit according to claim 3, wherein said output signal detection means detects the number among said plurality of potential difference sensing means that generated output signal(s).

5. A time interval measurement circuit according to claim 1, wherein each one of said output terminals of said differential output drivers connected to a first one of said two transmission lines outputs a pulse signal of a first polarity type which is in phase with the corresponding input signal and the other of said output terminals connected to the other of said transmission lines outputs a pulse signal of a second polarity opposite said first polarity.

6. A time interval measurement circuit according to claim 5, wherein each of said plurality of potential difference sensing means are comprised of a diode bridge switch circuit arrangement having a storage capacitance for holding the output signal generated therefrom.

7. A time interval measurement circuit according to claim 5, wherein said first polarity is positive and second polarity is negative.

8. A time interval measurement circuit according to claim 7, wherein said output signal detection means detects that one of said plurality of potential difference sensing means which has generated an output signal.

9. A time interval measurement circuit according to claim 8, wherein each of said plurality of potential difference sensing means are comprised of a diode bridge switch circuit arrangement having a storage capacitance for holding the output signal generated therefrom.

10. A time interval measurement circuit according to claim 1, wherein each said differential output driver provides complementary output pulse signals at the output terminals thereof, one of which is in phase with the corresponding input signal.

11. A time interval measurement circuit according to claim 10, wherein each of said plurality of potential difference sensing means area comprised of a diode bridge switch circuit arrangement having a storage capacitance for holding the output signal generated therefrom.

12. A time interval measurement circuit according to claim 10, wherein each of said plurality of potential difference sensing means are comprised of a diode bridge switch circuit arrangement having a storage capacitance for holding the output signal generated therefrom.

13. A time interval measurement circuit comprising:

two parallel transmission lines;

first and second differential output drives, each having an input terminal for receiving an input signal and a pair of output terminals for providing output signals and wherein the pair of output terminals of said first and second differential output drivers are respectively coupled to first and second ends of said transmission lines;

a plurality of potential difference sensing means each being respectively coupled between said transmission lines and distributed thereat at predetermined intervals so as to generate an output signal when it is switched to its ON condition which is indicative of a potential difference between said two transmission lines which is above a predetermined level in response to transmission line signals from the outputs of said first and second output drivers; and output signal detection means coupled to said plurality of potential difference sensing means for detecting output signals generated by said potential difference sensing means in response to said ON condition which is indicative of the time interval between respective input signals applied at the input terminals of said differential output drivers.

14. A time interval measurement circuit according to claim 13, wherein said detection means comprises a decoder.

15. A time interval measurement circuit according to claim 13, wherein each said differential output driver provides complementary output pulse signals at the output terminals thereof, one of which is in phase with the corresponding input signal.

16. A time interval measurement circuit according to claim 13, wherein each one of said output terminals of said differential output drivers connected to a first one of said two transmission lines outputs a pulse signal of a first polarity type which is in phase with the corresponding input signal and the other of said output terminals connected to the other of said transmission lines outputs a pulse signal of a second polarity opposite said first polarity.

17. A time interval measurement circuit according to claim 16, wherein said first polarity is positive and second polarity is negative.

18. A time interval measurement circuit according to claim 17, wherein said ON signal detection means detects that one of said plurality of potential difference sensing means which has generated an ON signal.

19. A time interval measurement circuit according to claim 13, wherein an input signal applied to one of said transmission lines comprises a step waveform signal having a rising edge, and an input signal applied to the other of said transmission lines comprises a step waveform signal having a falling edge.

20. A time interval measurement circuit according to claim 19, wherein said ON signal detection means detects the number among said plurality of potential difference sensing means which have generated an ON condition indication signal.

21. A time interval measurement circuit comprising:

two parallel transmission lines;

first and second differential output drives, each having an input terminal for receiving an input signal and a pair of output terminals for providing output signals and wherein the pair of output terminals of said first and second differential output drivers are respectively coupled to first and second ends of said transmission lines;

a plurality of diode bridge switching circuits each being respectively coupled between said transmission lines and distributed thereat at predetermined intervals so as to generate an output signal indicative of a potential difference between said two transmission lines which is above a predetermined level in response to transmission line signals from the outputs of said first and second output drivers; and output signal detection means coupled to said plurality of diode bridge sensing circuits for detecting output signals generated by said diode bridge sensing circuits which is indicative of the time interval between respective input signals applied at the input terminals of said differential output drivers.

22. A time interval measurement circuit according to claim 21, wherein an input signal applied to one of said transmission lines comprises a step waveform signal having a rising edge, and an input signal applied to the other of said transmission lines comprises a step waveform signal having a falling edge.

23. A time interval measurement circuit according to claim 22, wherein said detection means detects the number among said plurality of diode bridges which have turned on.

24. A time interval measurement circuit according to claim 21, wherein each one of said output terminals of said differential output drivers connected to a first one of said two transmission lines outputs a pulse signal of a first polarity type which is in phase with the corresponding input signal and the other of said output terminals connected to the other of said transmission lines outputs a pulse signal of a second polarity opposite said first polarity.

25. A time interval measurement circuit according to claim 24, wherein said first polarity is a positive and second polarity is negative.

26. A time interval measurement circuit according to claim 25, wherein said detection means detects that one of said plurality of diode bridges which has turned on.

27. A time interval measurement circuit according to claim 21, wherein said detection means comprises a decoder.

* * * * *